United States Patent [19]

Brock et al.

[11] 3,984,894

[45] Oct. 12, 1976

[54] SWEEPING VEHICLES FOR SWEEPING ROADS AND OTHER SURFACES

[76] Inventors: Albert Brock, Schafereiweg 11, 3007 Gehrden; Karl-Heinz Splisteser, Gaussstrasse 19, 3000 Hannover; Werner Dobbrunz, Ihmestrasse 117, 3005 Hemmingen, all of Germany

[22] Filed: Apr. 15, 1975

[21] Appl. No.: 568,178

[30] Foreign Application Priority Data

Oct. 1, 1974 Germany ..... 2446728

[52] U.S. Cl. ..... 15/340; 15/354; 15/418; 15/419

[51] Int. Cl.[2] ..... A47L 9/00; A47L 9/02

[58] Field of Search ..... 15/340, 354, 347, 415, 15/416, 418, 419

[56] References Cited

UNITED STATES PATENTS 2,131,398 9/1938 Hubbart ..... 15/340 X 3,862,469 1/1975 Burgoon ..... 15/418 X

FOREIGN PATENTS OR APPLICATIONS 588,799 2/1959 Italy ..... 15/340

*Primary Examiner*—Christopher K. Moore

*Attorney, Agent, or Firm*—Mason, Mason & Albright

[57] ABSTRACT

A sweeping vehicle for sweeping roads and other surfaces comprises a suction mouth located behind a sweeping brush. The inlet portion of the suction mouth is inclined relative to the surface to be swept and faces in a direction towards the brush. Air guide means extending from a trailing edge of the suction mouth approximately parallel to the surface, acts to direct air towards the suction mouth. The arrangement of the suction mouth and air guide means prevents particles of dirt from being discharged from the zone of the suction mouth by a vortex within the suction mouth.

2 Claims, 3 Drawing Figures

SWEEPING VEHICLES FOR SWEEPING ROADS AND OTHER SURFACES

BACKGROUND OF THE INVENTION

1. Field of the Invention

The present invention relates to sweeping vehicles for sweeping roads or other surfaces.

2. Description of the Prior Art

Sweeping vehicles have been proposed with low pressure delivery and with a sweeping and picking up assembly having a suction mouth connected by a suction pipe with a rubbish separator or container. By means of suction applied to the mouth, sweepings fed from sweeping means mounted ahead of the mouth are picked up and delivered to the rubbish container.

The suction mouth normally comprises a duct extending at its extremity into a funnel shape or rectangular or other cross-section. With previously proposed arrangements, there occurs phenomenon which may be termed as a suction vortex effect and which causes small particles of dirt to be hurled, with a force depending on the strength and speed of the suction stream, from the suction zone of the mouth back on to the surface being swept so that they are not picked up. Effective sweeping and picking up can only be achieved by using additional aids.

In order to reduce the effects of this phenomenon, it has been proposed to provide the suction mouth, in addition to a conventional seal of an elastic material, with sealing elements such as strips of bristle. This arrangement does not, however, operate satisfactorily.

It has also been proposed to arrange air nozzles behind the mouth and which are supplied with air from the exhaust section of the fan producing the suction stream, the air discharged from the nozzles acting to prevent discharge of dirt particles from the suction zone. This arrangement requires a greater number of constructional elements and thus presents from a technical point of view an expensive solution. Further it is essential that the whole arrangement of suction mouth with jets shall be completely sealed behind the surface being swept since otherwise, in dry weather, the air blast, full of dust, will overflow to the outside. This effect is particularly likely to occur when uneven surfaces are swept as for example paved streets, and gutters, which is a disadvantage as the joints between the paving stones inevitably cause breakup of the air under the sealing elements which likewise encourages an outflow of the air blast. This previously proposed sweeping vehicle is thus limited to use on concrete roads or asphalted surfaces.

SUMMARY OF THE INVENTION

According to the present invention, there is provided in a sweeping vehicle, a sweeping and collecting assembly, said assembly comprising means defining a suction mouth, said mouth having an inlet facing in the direction of travel of the vehicle and being inclined at an acute angle with respect to the surface to be swept, and air guide means located behind the inlet with respect to the direction of travel of the vehicle, said guide means being arranged to extend generally parallel to the said surface, and said guide means extending rearwardly from said inlet.

The inclination of the inlet of the suction mouth and thus the suction stream, with respect to the surface to be swept, results in an inclination of the suction duct defined by the mouth and a corresponding displacement of the suction vortex arising at the inlet. The direction of the radial centrifugal forces acting on the particulate rubbish and which are caused by the air vortex, does not extend parallel to the surface to be swept as occurs in the previously proposed arrangements, but strikes in the region of the rear wall of the suction duct at a known angle to the surface to be swept so that the particles of rubbish from the surface to be swept are hurled in the same direction and rebound, to be directed by the partial air stream from the air guide means and thus reach the main suction air stream.

In a preferred embodiment of the invention, the air guide means is connected to the rear wall of the suction mouth by an elastic joint so that when travelling over comparatively high obstacles e.g., projecting drain covers in built-up areas, the guide means can be turned upwards and rearwards. Advantageously, the guide means is adjustable in height.

BRIEF DESCRIPTION OF THE DRAWINGS

An embodiment of the invention will now be described, by way of example only, with reference to the accompanying diagrammatic drawing, in which.

DESCRIPTION OF THE PREFERRED EMBODIMENTS

Figure 1:
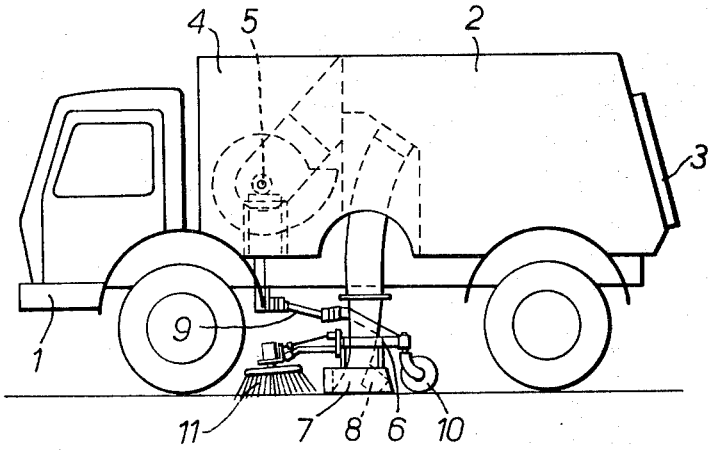
FIG. 1 is a side elevation of a sweeping vehicle according to the invention.

As shown in FIG. 1, the vehicle comprises a chassis which carries a rubbish separator and collection container 2 fitted with a flap 3 for emptying the container and a space 4 for a motor driven fan assembly 5 and other associated machinery. Between the front and rear wheels of the vehicle a sweeping and suction assembly 6 is mounted, the assembly being suspended from the chassis 1. The assembly comprises a suction mouth 7, sealing elements 8, support and guidance means 9, support wheels 10 and sweeping brushes 11; the brushes 11 are located in front of the suction mouth 7 and act to sweep the rubbish from gutters and the like into the suction zone of the suction mouth 7.

Figure 2:
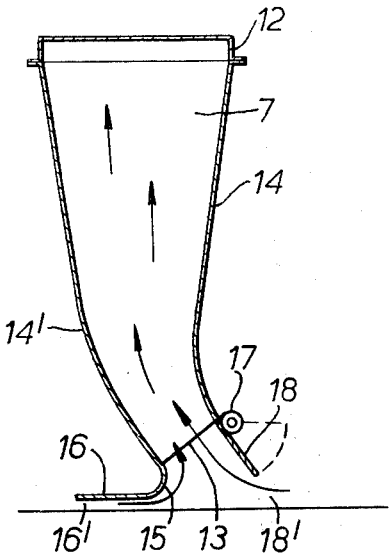
FIG. 2 is a schematic section showing a suction mouth of the vehicle.

As shown in FIG. 2, the suction mouth 7 has, at its upper end portion, a suction pipe-connection union 12 of circular cross-section, the remaining portion of the mouth 7 below the union 12 being progressively developed into the form of a body of rectangular cross-section. The front wall 14 and rear wall 14′ of the suction mouth 7 are, in the region of the inlet 13, of the suction mouth 7 bent forwardly in a gentle curve with the result that the suction mouth inlet 13 faces towards the front of the vehicle in the direction of travel of the vehicle and makes a acute angle with the surface to be swept, the inlet 13 thus facing approximately in the direction of flow of suction air and rubbish mixture coming from the front. Preferably the inlet 13 of the suction mouth 7 is inclined to the surface being swept by an acute angle of between 10° and 70° an inclination of between 15° and 20° being particularly advantageous.

Instead of forming a bend in the suction mouth 7, the mouth can run straight and can be rearwardly inclined at a predetermined angle to the vertical, so that the inlet 13 of the suction mouth 7 is inclined as described above.

The rear wall 14' of the suction mouth 7 is angled towards the rear with a gentle curve 15 for partial air guidance at the lower end in such a way that the extension of the wall horizontally, which serves as an air guide means 16, lies parallel to the surface to be swept.

At the lower end of the front wall 14 adjacent the inlet 13, there is arranged a coarse pick-up flap 18 which is capable of being hinged upwardly towards the front about a pivot 17. This flap 18 serves as an extension of the front wall 14 of the suction mouth 7, and extends in the same direction. With heavy soiling the flap 18 can be swung up about pivot 17 by any suitable means.

The level of the suction mouth 7 is so fixed in operation that between the surface to be swept and the under surface of the coarse pick-up flap 18 on the one side as well as the air guide means 16 on the other side respectively, a correspondingly greater air aperture 18' or 16' is preserved.

As can be seen from FIG. 2, the direction of the air vortex produced is changed by means of the lower part of the suction mouth 7. The components of the radial centrifugal forces in the air vortex are inclined at the same angle to the surface to be swept as the inlet 13 of the suction mouth 7. The consequence of this is that the particulate rubbish, which in the previously proposed arrangement was thrown out of the rear, impinges on the swept surface adjacent the inlet 13, rebounds from this surface and is led back into the suction mouth 7 by means of the air stream directed through the aperture 16' by the air guide means 16. The correct operation of the suction air stream including the transported rubbish is maintained even when travelling over uneven ground so that a correction of the height of the suction mouth is not needed.

Figure 3:
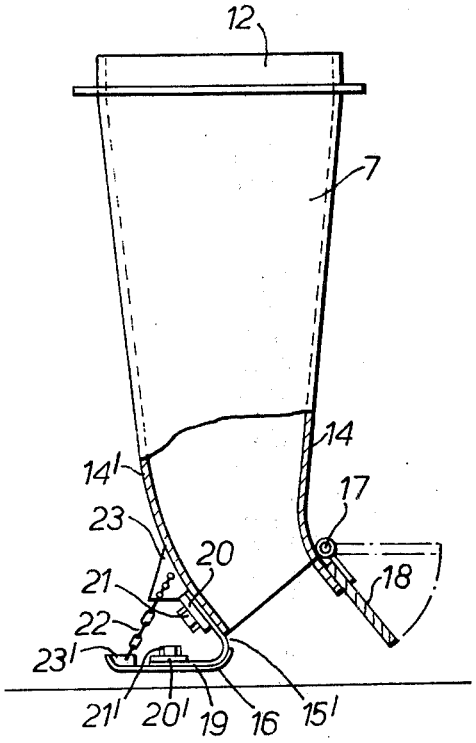
FIG. 3 is a side elevation, partly in section of the suction mouth shown in FIG. 3.

FIG. 3 shows further practical details of the suction mouth 7.

In practice, the rear wall 14' and the air guide means 16 is attached to it does not — as shown schematically in FIG. 2 — consist of a single part since the air guidance means 16 must move elastically to avoid contact with obstacles encountered. The rear wall 14' and the air guide means 16 are thus separated above the curve 15. The gap 15' thus formed at the curve is bridged by an elastic member 19 which is fixed to the above-mentioned components by means of clamping bars 20, 20' and screws 21, 21'.

The air guide means is secured in a selected position by means of an adjusting and locking arrangement 22. The adjustment is carried out by means of tensioning elements which, for example, may consist of a linkage with an articulated support or a chain or a steel cable which is articulated with the aid of strap joints 23, 23' to the rear wall 14' of the suction mouth and the rear edge of the air guide means 16.

In order that subsequent adjustment can be made to the height of the air guidance means 16 and of the air aperture 16', the tensioning elements 20, 21 are so constructed that after slackening the tightening screws 21 for the elastic member 19 and the air guide means 16, corresponding upwards or downwards adjustment is possible. In dependence on the height adjustment described above, corresponding adjustment will be required at the same time for the adjusting and locking arrangement 22. This can be achieved, for example, by providing the upper strap joint 23 with support points for the tension elements which are variable with height.

The arrangement of the suction mouth 7 as described above is independent of the kind of chassis on which it is mounted and of the design of the sweeping vehicle. The cross-sectional configuration and the construction of the suction mouth may differ from that shown.

By arranging the suction mouth in the manner described the adverse effects hitherto caused by the suction vortex are obviated in a simple and inexpensive manner, and an effective cleaning action is provided.

The air guide means is maintained at known distance from the surface to be swept, whereby an effective uptake is ensured when travelling over an uneven surface which is to be swept. At the same time it is possible to cleanse gutters, which present a discontinuity to the road surface, without the need for adjusting of the height of the suction mouth by altering the setting of its support wheels.

What is claimed is:

1. In a sweeping vehicle, a sweeping and collecting assembly, said assembly comprising means defining a suction mouth having a front wall and a rear wall, said mouth having an inlet facing in the direction of travel of the vehicle and being inclined at an acute angle with respect to the surface to be swept, air guide means located behind the inlet with respect to the direction of travel of the vehicle, said guide means being arranged to extend generally parallel to the said surface, and said guide means extending rearwardly from said inlet, and resilient mounting means mounting the guide means on the rear wall of the mouth.

2. A vehicle according to claim 1, further comprising adjustable means securing the guide means in a selected position relative to the said surface.

* * * * *